United States Patent [19]

Wertlake et al.

[11] 3,945,523

[45] Mar. 23, 1976

[54] FREEZE STORAGE CONTAINER SYSTEM

[75] Inventors: Paul T. Wertlake, Short Hills; James S. Harrison, Ringwood, both of N.J.

[73] Assignee: Applied Bioscience, Fairfield, N.J.

[22] Filed: Apr. 14, 1975

[21] Appl. No.: 567,990

Related U.S. Application Data

[63] Continuation of Ser. No. 373,083, June 25, 1973, abandoned.

[52] U.S. Cl. ..... 215/1 R; 215/DIG. 3

[51] Int. Cl.[2] ..... B65D 1/00

[58] Field of Search ..... 215/1 R

[56] References Cited

UNITED STATES PATENTS 1,270,305 6/1918 Lent ..... 215/1 R 2,858,036 10/1958 Earle ..... 215/1 R

*Primary Examiner*—Donald F. Norton

[57] ABSTRACT

A system for the transferral, freezing, storage and processing of liquids with a minimum of contamination is described. The components of the system include a hollow disc-shaped vessel of special construction which permits rapid freezing at extremely low temperatures, a pierceable, resilient sealing member on the ports of the disc-shaped vessel and a pointed cannular needle which is protected from contamination prior to use and operable to pierce the sealing member free of any contamination.

2 Claims, 7 Drawing Figures

FIG. 1
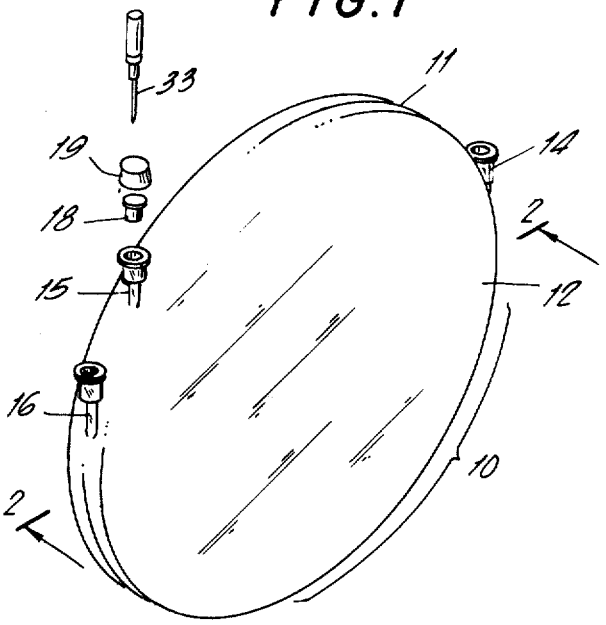
FIG. 3
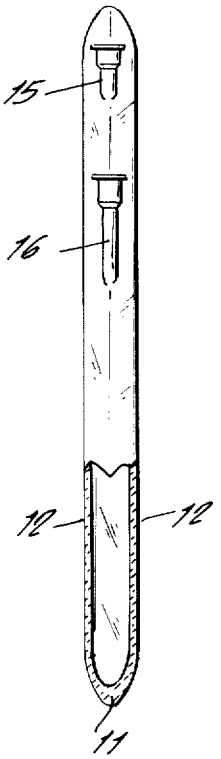
FIG. 2
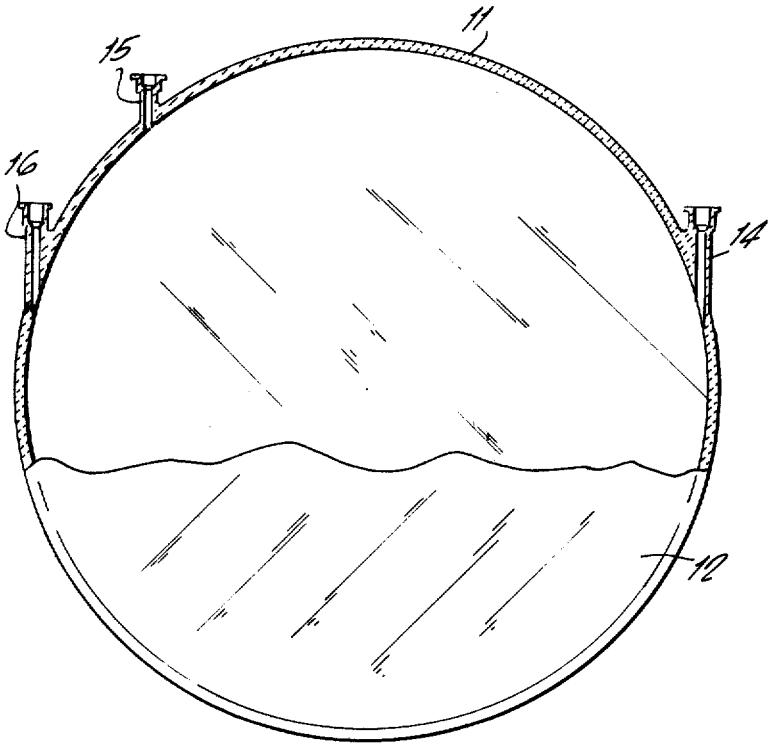
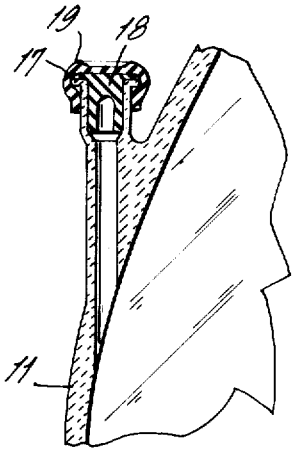
FIG. 4

FIG. 5
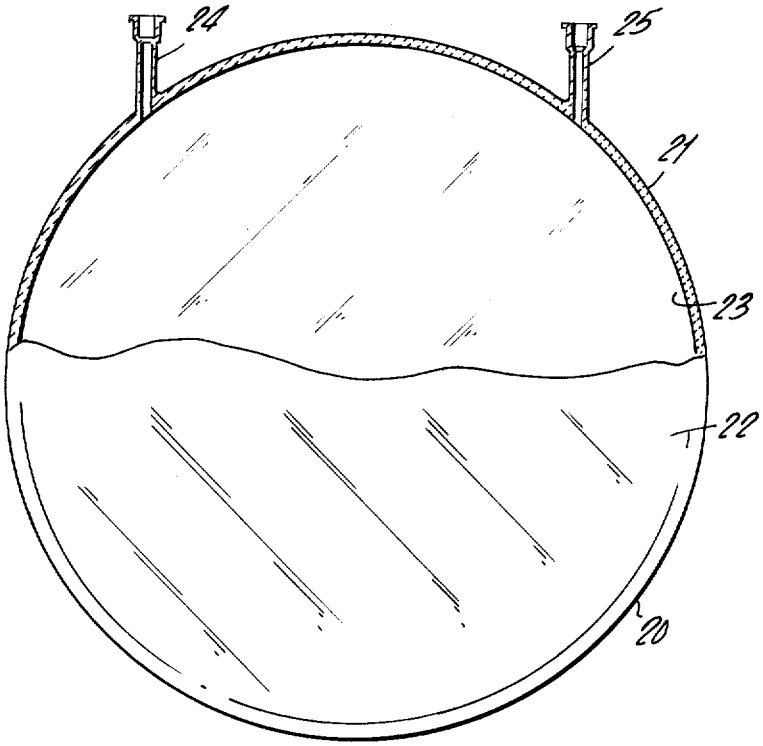
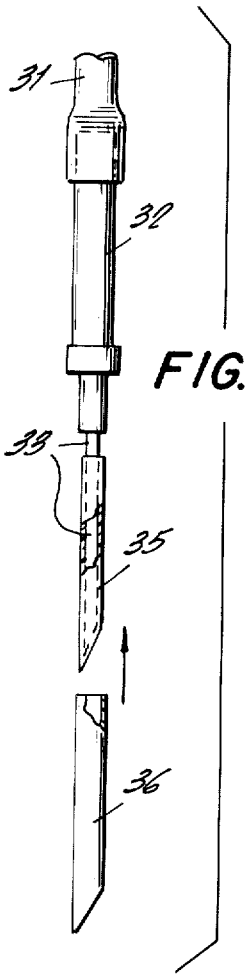
FIG. 6
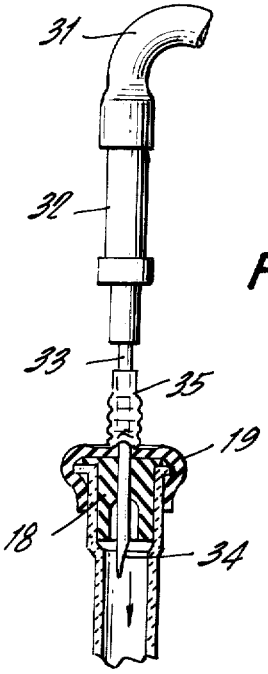
FIG. 7

FREEZE STORAGE CONTAINER SYSTEM

This is a continuation of application Ser. No. 373,083, filed June 25, 1973, now abandoned.

BACKGROUND OF THE INVENTION

The need for aseptic transfer, storage and processing of various biological liquids is well recognized. While this need is a practical consideration in such operations as microbiological fermentation and lyophilization, it takes on even greater importance in hematological operations. Thus for example, the various operations involved in blood transfusions necessitate the utmost care in the maintenance of aseptic conditions. The chances of contamination are especially great in indirect transfusion since the requisite transfer of the blood in the course of processing, freezing and storage involves a number of individual manipulations, each of which presents an opportunity for contamination. The present limitations on the permissible time during which previously frozen blood may be used are largely based on these contamination possibilities inherent in an open system.

In a closed system, the blood is transferred directly from the donor into a closed, aseptic system capable of performing the requisite processing steps. The blood is subjected to these various steps in different portions of the system without being removed at any time and without the introduction into the system of any other materials. While blood which is processed in a closed system can be safely maintained for a long period of time, the operation is so cumbersome and expensive when applied to frozen-thawed blood products that it is not presently feasible to employ.

In an open system, the various operations are conducted separately in different containers. Because of the inherent possibility of contamination in the course of transfer from one container to another and in the addition of processing materials, blood frozen and processed in an open system has a much shorter permissible period of use.

The actual freezing of the blood in the open system is generally performed in one of two ways. In the so-called "high glycerol content" technique, the blood is mixed with a quantity of glycerol to minimize cell damage and subjected to temperatures of −80° to −90° C. When the blood is ready for use, it is thawed, as for example through immersion in warm water, and then treated with an osmotic gradient such as saline solution to draw out the glycerol. In the second method, the so-called "low glycerol content" technique, the blood is rapidly frozen in the liquid phase of liquid nitrogen, that is at −196° C. Although glycerol is also added in this technique prior to the freezing, the amount which is added is considerably less than in the first technique. When the blood is to be used, it is thawed, again simply by immersion in warm water, and again treated with an osmotic gradient to remove the glycerol.

Originally, the container for the blood was fabricated out of stainless steel in order to withstand the stresses encountered on a structure upon plunging it into liquid nitrogen. These containers were invariably rectangular canisters having a thickness no greater than about three-eighths of an inch in order to incur the rapid and uniform freezing of the canister's contents. More recently, the use of stainless steel canisters has been largely replaced through the introduction of special plastic containers. These are generally constructed out of polyvinyl chloride and supported in a rigid cassette. To minimize the dangers of contamination, current regulations and practice precludes the use of any plasticizer in the formulation of the PVC. While the plastic containers are an improvement over the stainless steel containers, experience has shown that a failure rate of about 2 to 3 percent can be expected. These failures, which probably occur in the course of freezing but which cannot be detected until thawing, constitute a very serious disadvantage to the use of plastic containers for the freezing of blood. Moreover, plastic containers are not reuseable and thus constitute an expensive if not wasteful luxury.

Finally, in any open system, whether the container employed is a stainless steel canister or a plastic bag, the possibility of contamination in the course of transfer and the resultant limitations on the time in which the blood may be safely used are highly undesirable. It is clear from the foregoing that a definite need exists for a system which eliminates the possibility of outside contamination yet permits the flexibility of the open system of blood freezing and at the same time permits the minimization of loss through container failure and the reuse of the containers.

DETAILED DESCRIPTION

The present invention provides a system, including its various components individually, for the transferral, freezing, storage and processing of liquids with minimum contamination. Although the system is most notably employed in the processing of blood, it is also useful in microbiological processes such as fermentation and in the lyophilization of pharmaceutical preparations and biological materials.

It is an object of the present invention to provide a system which permits the freezing of liquids at extremely low temperatures by the rapid insertion of a suitable container with a minimum of danger of container failure.

A further object of the present invention is to provide a system in which the frozen liquid can be conveniently stored in suitable refrigeration means and be readily observable throughout storage.

A further object of the present invention is to provide a system which permits the introduction of processing substances into the contents of the container, and/or the removal of liquid from the container, without contamination of the interior of the container or its contents.

These and other objects of the invention will be apparent from the present specification and from the drawings in which:

FIG. 1 is a perspective view of the freezing and storage vessel;

FIG. 2 is a partially cutaway side view of the vessel;

FIG. 3 is a partially cut-away end view of the vessel;

FIG. 4 is a detailed view in cross section of the tubular port of the vessel;

FIG. 5 is a partially cut-away side view of a further embodiment of the present invention;

FIG. 6 is a partially cut-away elevation of the pointed cannular needle, associated tubing and protective cap prior to use; and FIG. 7 is a cross section of the tubular port with its seal depicting the rupture and foldable retraction of the coating of the cannular needle in the course of insertion of the needle into the surface of the seal.

Referring now to the drawings in a greater detail, there is shown in FIGS. 1, 2 and 3 a disc-shaped vessel having an annular outside wall 11 of uniform thickness and a pair of substantially flat and parallel faces 12 and 13 which are continuously joined to and integral with the edges of wall 11. Disposed on the wall and integrally joined thereto are a plurality of tubular ports 14, 15 and 16 which communicate with the interior volume of vessel 10. As can be seen from FIG. 3, the tubular ports are disposed so that their axis is coplanar with the principal plane of the disc shaped vessel.

Each of the tubular ports has a lip portion 17 at its open end operable to engage sealing means 18 and 19. While sealing means 18 and 19 are depicted as being composed of two components, namely plug 18 and cap 19, it is apparent that this sealing component may be fabricated in a single unit.

The material from which the disc-shaped vessel and its tubular ports are constructed is of critical importance. Heretofore, it has been generally expected that glass containers could not be immersed rapidly in refrigerants at temperatures as low as −170° C, the vapor phase temperature of liquid nitrogen, and certainly not at −196° C, the temperature of liquid nitrogen, for fear of shattering. It has now been discovered that specially treated borosilicate glass having a low coefficient of expansion can be repeatedly immersed in liquid nitrogen without shattering or exploding. Borosilicate glass having a low coefficient of expansion is a well known article of commerce, being sold for example in a number of forms under the trademark PYREX. Such a glass will have a silica content of from about 55 to about 85 percent, a boron oxide content of from about 5 to about 30 percent, an aluminum oxide content of 0 to about 20 percent, a lead oxide content of from 0 to about 6 percent, a magnesium oxide content of from 0 to about 12 percent, and varying amounts of other alkaline oxides, ranging from about 2 to about 6 percent. These borosilicate glasses will demonstrate a low coefficient of expansion; i.e. approximate 3 to $5 \times 10^{-6}$.

Such commercially available material will not however withstand the rigors of immersion in liquid nitrogen and it is well known that such immersion will generally result in a shattering of the container. It has been discovered however that if this commercially available material, which was previously annealed in the course of manufacture, is again subjected to a second annealing treatment to effect stress relief, thee resultant glass is capable of withstanding the temperatures encountered in immersion in liquid nitrogen. The conditions of this second annealing process are substantially the same as those utilized with any given glass and the optimum temperature and cooling rates may be found according to known relationships from the particular expansion coefficient of the glass, its thickness, thermal diffusivity and elastic constant. Typical borosilicate glasses having a low coefficient of expansion include those sold under the trademark PYREX 1720, 7070, 7720 and 7740.

Returning now to the drawings, there is shown in FIG. 5 a second embodiment of the disc-shaped vessel 20 having annular wall 21 and a pair of parallel faces 22 and 23. In this embodiment, the disc-shaped vessel has only two tubular ports 24 and 25. Although it is possible to fabricate the disc-shaped vessel with only a single port, it is more convenient to utilize two and preferably three ports, a first for introduction of the blood or other liquid to be frozen and a second for simultaneous escape of the displaced air in the vessel. Utilization of a third port, as shown in FIGS. 1, 2 and 3, permits the introduction of processing substances, either simultaneously or at a later time.

The circular perimeter and dimensions of the disc-shaped vessel according to the present invention are also important. Thus it is possible to employ dimensions in which the width of the face of the container is reduced and the thickness increased. This in turn results in the possibility of employing a smaller container for the liquid nitrogen than would be possible with, for example, a rectangular or square container. Surprisingly it has been found that the dimensions of the disc-shaped vessel can have a very significant effect on the properties of the blood. In contrast to the thin metal canisters, and plastic bags which are completely filled, the present vessels are designed so as to have a volume approximately 50 to 100 percent greater than that of the blood mixture being processed. For example, if the total liquid being frozen is, for example, 700 ml including 350 ml of blood and an approximately equal amount of glycerol, the volume of the container should be approximately 1000 to 1400 ml. Moreover, the relationship of volume to radius should be such that the product of the ratio of total volume of red cells being processed in ml to the square of the inside radius of the disc-shaped vessel in cm times $cm^{-1}$ should be no more than $\pi$. These conditions have been found to result in less hemolysis and a brighter product when blood is processed in the disc-shaped vessel than has heretofore been obtained with plastic or metal containers.

The tubular ports are, as has been noted, disposed within the plane of the vessel to facilitate storage, as for example by stacking. Moreover it is desirable, although not necessary, that the ports terminate at a distance from the annular wall below the intersection of the port's axis with a line perpendicular thereto and tangential to the annular wall. This preferred arrangement, which is embodied in the vessel depicted in FIGS. 1 through 3, permits the entire vessel to fit within the smallest possible square area which is needed to receive the circular portion of the vessel.

While the disc-shaped vessel of the present invention thus represents in and of itself an improvement over cannisters and plastic containers heretofore employed, it is particularly advantageous for use in an entire system of transferring, freezing, storing and processing liquids with minimum contamination. A second important conponent of this overall system is the pointed cannular needle shown in FIGS. 6 and 7. This needle, which is connected to an appropriate conduit such as tubing 31 through adapter holder 32, comprises a shaft portion 33 and a point portion 34. Sheathing point 34 and a portion of shaft 33 is a continuous coating 35 of a rupturable flexible plastic such as for example polyvinyl chloride, polyethylene or the like. Coating 35 serves to prevent contamination of so much of the needle as is coated, it being apparent that the needle can be sterilized prior to this coating. The coating can be tightly adhered to the entire needle, as for example, through heat shrinking or preformed, slipped over the needle and constricted at the top to seal the covered shaft. A cap member 36 can be provided to protect this coating, and the needle, prior to use.

As shown in FIG. 7, the needle is inserted into a sealing member by the application of force exerted upon the needle against the seal. This force results in needle point 34 first piercing the coating and then the seal itself. The coating upon this piercing or rupture foldably retracts along the shaft of the needle under the pressure and movement of insertion. Consequently, the sterile needle moves directly from the aseptic conditions existing under the coating prior to use through the sealing member into the interior areas of the vessel and is at no time exposed to the air or outside environment. It is apparent that additional protection against contamination can be achieved by using a similar coated needle in the actual venipuncture of the donor, the skin here serving to foldably retract the sheathing.

By equipping the disc-shaped vessel of the present invention with a pierceable resilient member sealing the open end of each of the vessel's tubular ports and utilizing the coated cannular needle of the present invention, it is thus possible to achieve a system which enjoys the flexibility of the open blood processing systems and at the same time minimize if not eliminate the opportunity for contamination which heretofore was enjoyed only by the closed blood processing systems. It should be noted that the success of this system is in large measure due to the interworkings of the individual components. Thus the specially treated glass disc-shaped vessel provides a rigid and reuseable container which not only withstands the rigors of being rapidly subjected to temperatures as low as −196° C but permits an immediate visual observation of the condition of its contents. The coated cannular needle provides a means for eliminating any contamination of the blood or other liquid in the course of its introduction into this special vessel.

It is apparent that the various specific embodiments described herein may be varied and modified without departure from the spirit of the present invention since such embodiments have been presented solely for the purpose of exemplification and not for limitation, the invention being defined solely by the added claims.

What is claimed is:

1. A container for use in the rapid freezing of liquids through immersion in liquid refrigerants and in the subsequent storage and processing of the frozen or thawed liquids comprising a hollow, disc-shaped vessel having a volume at least 50 percent greater than that of the liquid to be frozen, said vessel being made entirely of double annealed borosilicate glass having a low coefficient of expansion and consisting essentially of an annular outside wall of uniform thickness and convex cross-section. a pair of substantially flat and parallel faces continuously joined to and integral with the edges of said annular wall, and three parallel tubular ports in communication with the interior of said vessel and projecting from and integral at one end with the annular wall and terminating at its other end below the intersection of its axis with a line perpendicular thereto and tangential to said annular wall, said ports being disposed within an arc of the annular wall of less than 180° in a plane parallel to said faces.

2. A container according to claim 1 wherein each of said ports has a lip portion at its open end operable to engage a sealing member.

* * * * *